US007207460B2

(12) United States Patent
Sander et al.

(10) Patent No.: US 7,207,460 B2
(45) Date of Patent: Apr. 24, 2007

(54) LAUNDRY BASKET WITH KNUCKLE PROTECTION

(75) Inventors: David R. Sander, Medina, OH (US); Fred Reber, Shreve, OH (US)

(73) Assignee: Rubbermaid Incorporated, Wooster, OH (US)

( * ) Notice: Subject to any disclaimer, the term of this patent is extended or adjusted under 35 U.S.C. 154(b) by 343 days.

(21) Appl. No.: 10/649,242

(22) Filed: Aug. 27, 2003

(65) Prior Publication Data

US 2005/0045649 A1 Mar. 3, 2005

(51) Int. Cl.
*B65D 6/00* (2006.01)
*B65D 25/00* (2006.01)

(52) U.S. Cl. ..... 220/676; 220/755; 32/37

(58) Field of Classification Search ..... D32/37; 220/755, 752, 756, 669, 675; 206/557
See application file for complete search history.

(56) References Cited

U.S. PATENT DOCUMENTS 4,288,102 A 9/1981 Ramer
5,118,108 A 6/1992 Wilmoth, III
D328,838 S * 8/1992 Avey et al. ..... D7/638
D372,568 S * 8/1996 Lippisch ..... D32/37
5,558,240 A * 9/1996 Karp ..... 215/398
5,667,069 A * 9/1997 Williams, Jr. ..... 206/370
D389,621 S * 1/1998 Short et al. ..... D32/37
5,851,484 A * 12/1998 Forno et al. ..... 422/28
6,039,205 A * 3/2000 Flink ..... 220/659
D425,275 S * 5/2000 Delouvre et al. ..... D32/37
D477,145 S * 7/2003 Sofy et al. ..... D3/307

* cited by examiner

*Primary Examiner*—Stephen Castellano
*Assistant Examiner*—Eugene Lhymn
(74) *Attorney, Agent, or Firm*—Marshall, Gerstein & Borun LLP

(57) ABSTRACT

A laundry basket includes a bottom wall and a contiguous sidewall extending up from the bottom wall that defines an interior of basket. A first handle is attached to the contiguous sidewall and includes a first grip and a first knuckle guard that is disposed spaced outward from the first grip in a direction away from the interior of the basket. The basket can include a second grip on a wall opposite the first grip and can include a third grip on an elongate wall that is opposite a curved hip hugger basket wall.

9 Claims, 7 Drawing Sheets

LAUNDRY BASKET WITH KNUCKLE PROTECTION

FIELD OF THE DISCLOSURE

The present disclosure relates to a protective transportable container and more particularly to a laundry basket structured to protect the hands of the user.

BACKGROUND OF THE DISCLOSURE

Laundry baskets are used to transport washable fabrics, such as clothing and towels, to and from a laundry room for cleaning. Most prior art laundry baskets, such as the example shown in FIG. 1, are designed to have a width W' that is approximately 24–27 inches. This is to ensure that the greatest amount of fabric can fit inside the basket so that the user is not forced to make several trips to transport a load of clothing.

Unfortunately, due to the width of the basket, the user may have difficulty navigating the basket through hallways and doorframes. The width of the laundry basket combined with the user's hands grasping the handles of the basket and extending beyond the basket can create an overall width of 28–32 inches. The doorframes of many houses are only 30–35 inches wide. This tight spacing creates a high risk that the user will strike his or her fingers and knuckles against a doorframe or walls, especially when the basket is full of clothing and more difficult to maneuver.

The prior art laundry basket 10, shown in FIG. 1, includes a lip 12 and handles 14 molded into the lip 12. The handles 14 are adapted to be grasped by a user such that the user can lift and carry the basket 10.

In use, the user grasps the outside of the handles 14, thus exposing his or her knuckles 16 outside of the basket 10, as is shown in FIG. 2. When the user attempts to leave a room, it is possible that his or her knuckles 16 will impact or scrape against a doorframe 18, causing discomfort or even bleeding.

Figure 1:
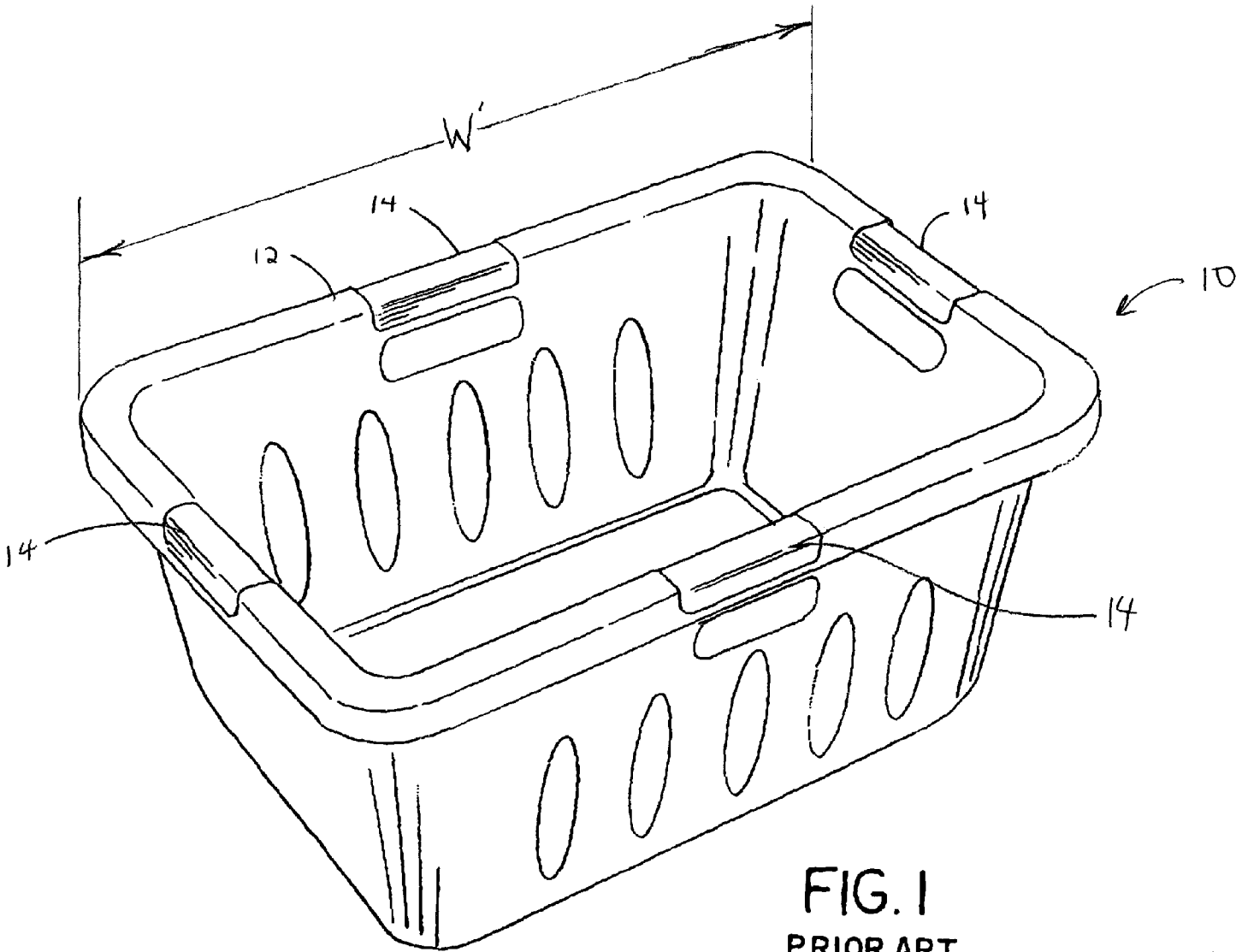
FIG. 1 PRIOR ART
FIG. 1 is a perspective view of a prior art laundry basket.
Figure 2:
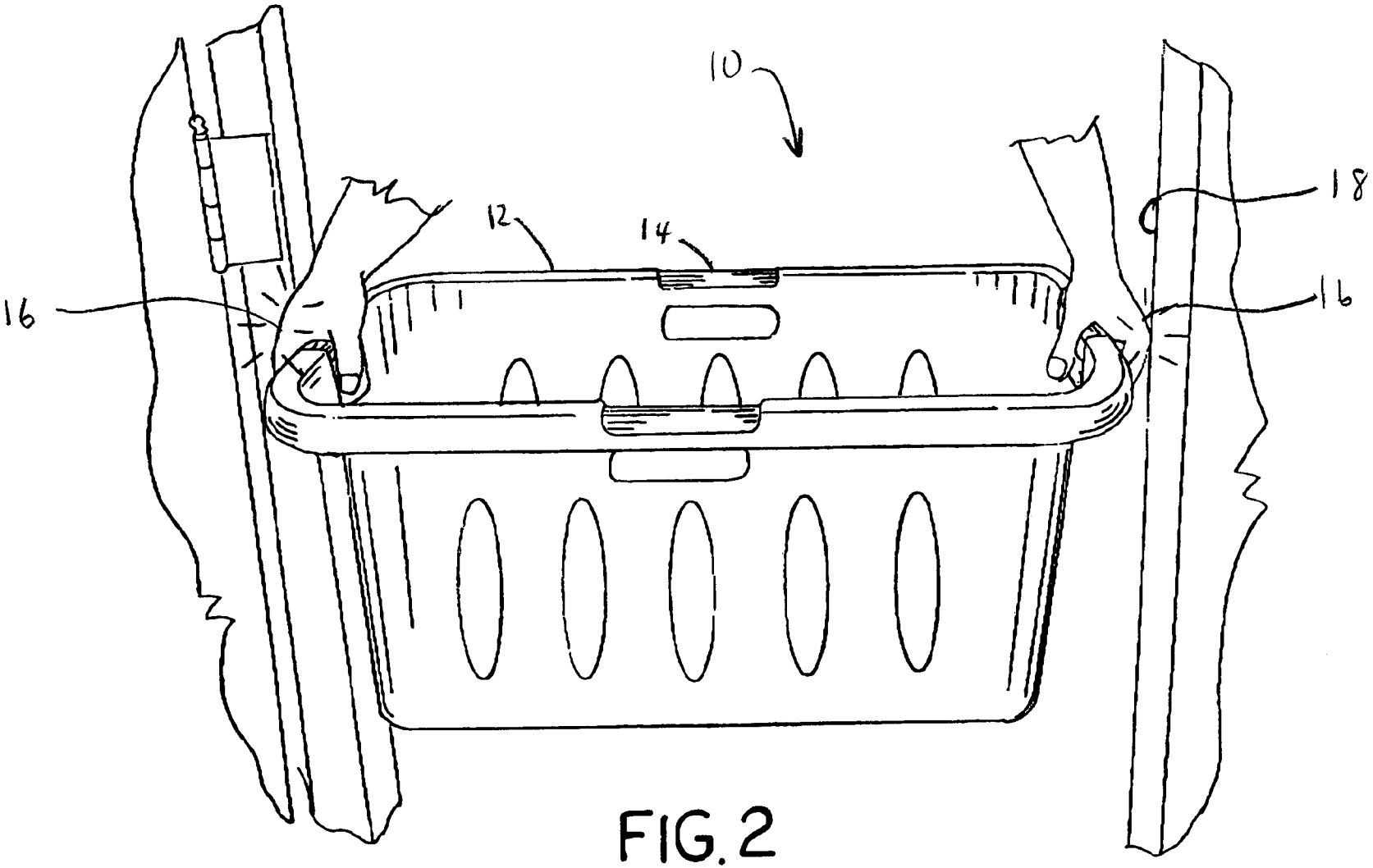
FIG. 2 PRIOR ART
FIG. 2 is a perspective view of the laundry basket of FIG. 1 being carried through a doorway.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Figure 3:
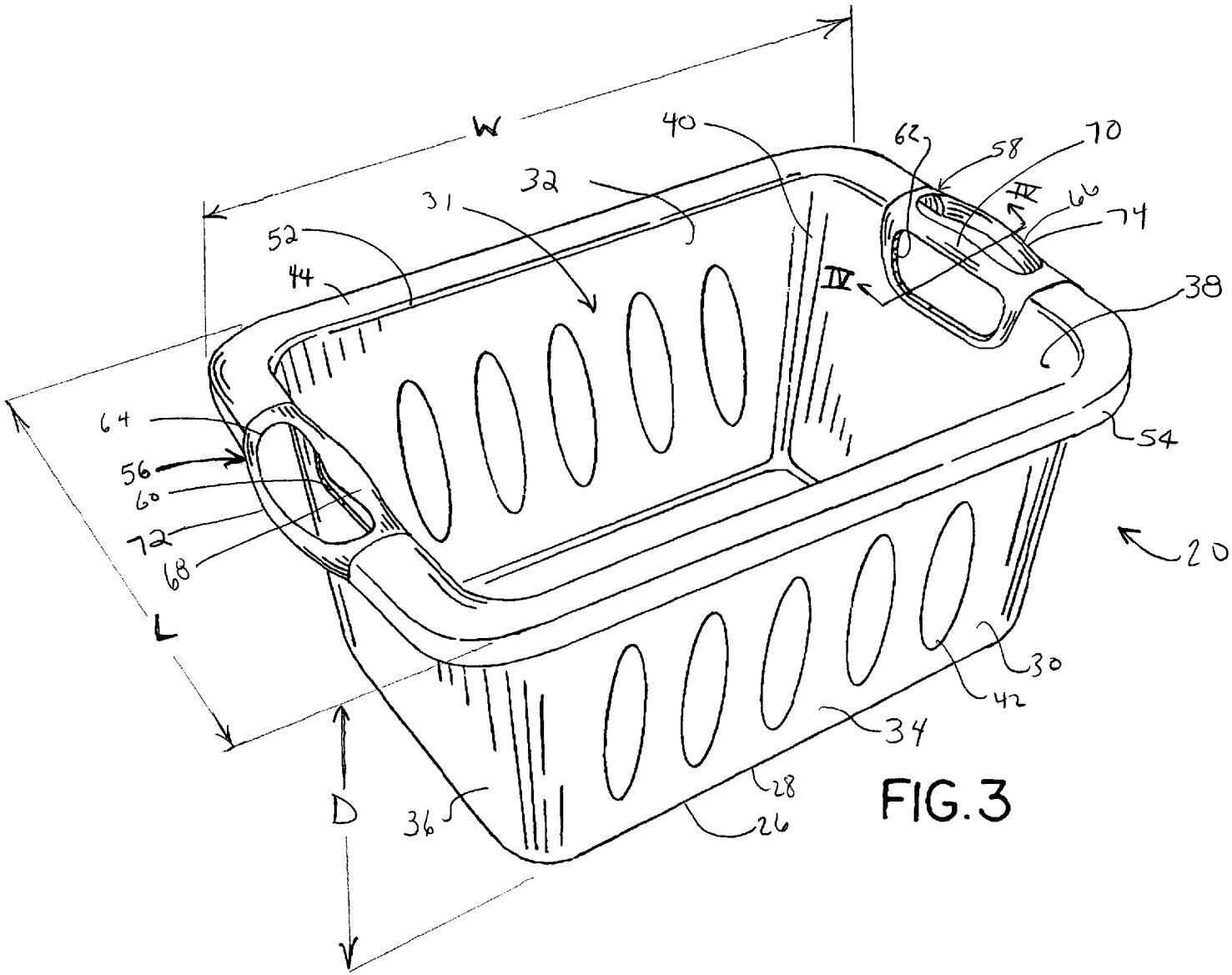
FIG. 3 is a perspective view of a first example of a laundry basket with knuckle protection.

Referring now to the drawings, and in particular to FIG. 3, a laundry basket 20 is disclosed. The basket 20 includes a bottom wall 26 with an outer periphery 28 configured to support a plurality of items within the basket. The basket 20 includes a contiguous sidewall 30 extending upward from the outer periphery 28 of the bottom wall 26. The bottom wall 26 and contiguous sidewall 30 define an interior 31 of the basket 20. In this example, the contiguous sidewall 30 includes a first sidewall 32, a second sidewall 34, a third sidewall 36, and a fourth sidewall 38. The sidewalls 32, 34, 36, and 38 help to maintain the items in the interior 31 of the basket 20. It is clear that the contiguous sidewall 30 can comprise more or less sidewalls, including a single cylindrical sidewall. In this example, the contiguous sidewall 30 is substantially rectangular. The first sidewall 32 and the opposite second sidewall 34 define a width W, and the third sidewall 36 and the opposite fourth sidewall 38 define a length L. In this example, the width W is longer relative to the length L.

The bottom wall 26 and the sidewalls 32, 34, 36 and 38 are shown being joined with radiused corners 40 and with the contiguous sidewall 30 being upwardly and outwardly tapered to facilitate stacking, provide good aesthetics, and eliminate sharp corners. The sidewalls 32, 34, 36 and 38 can include air vents 42 to increase the heat transfer and air transfer from the clothing to the atmosphere. This aids in drying any clothes that may be removed from a dryer while the clothing is still damp. In this example, the air vents 42 are depicted as a series of ellipses, but it is clear that any design of venting can be used. The air vents 42 also help reduce the amount of basket material and thus the weight of the basket.

The contiguous sidewall 30 further includes a lip 44. In this example, the lip 44 is disposed on top of the sidewalls 32, 34, 36 and 38 and extends from the sidewalls 32, 34, 36 and 38 in an outward direction away from the interior 31 of the basket 20. It can be joined to the sidewalls 32, 34, 36 and 38 at a radiused corner 52. The lip 44 further includes an edge 54 that extends downward from the outer edge of the lip 44.

On the lip 44 and the first and second sidewalls 32 and 34 is a first handle 56 and a second handle 58, respectively. First and second side openings 60, 62 are disposed in each of the first and second sidewalls 32 and 34 defining passageways through which a user's hand or fingers can pass.

First and second lip openings 64 and 66, disposed in the lip 44 adjacent the first and second side openings 60 and 62, also provide passageways through which a user's hand or fingers can pass. The portion of the laundry basket 10 above the first side opening 60 as well as the portion of the laundry basket 10 above the second lip opening 66 defines first and second grips 68, 70, respectively. The first and second grips 68, 70 can be ergonomically designed such that a user will have maximum control of the basket 20 while carrying it as is known in the art.

The handles 56, 58 further each include a knuckle guard 72, 74, disposed in the outward direction from the grips 68, 70. In this example, each knuckle guard 72, 74 is disposed adjoining the lip 44. As will be detailed later, the knuckle guards 72, 74 are configured to absorb the impact of a strike by the knuckle guard 72, 74 against a doorframe. In this example, the knuckle guard 72 is an arched bar, however any structure that provides a barrier between the grips 68, 70 and a possible impact against a doorframe or a wall is sufficient. In this example, the knuckle guard 72 is coextensive with the downward extending edge 54 of the lip 44, though it does not need to be. In another example, the knuckle guard 72 may be a bar spaced from and encompassing one side of the grip 68.

In other examples not shown, a lip 44 might not be used on a laundry basket. Handles can be disposed in the sidewalls 32 and 36, and a knuckle guard can extend around the grip. Thus, the guard and grip can be independent from a lip.

Figure 4:
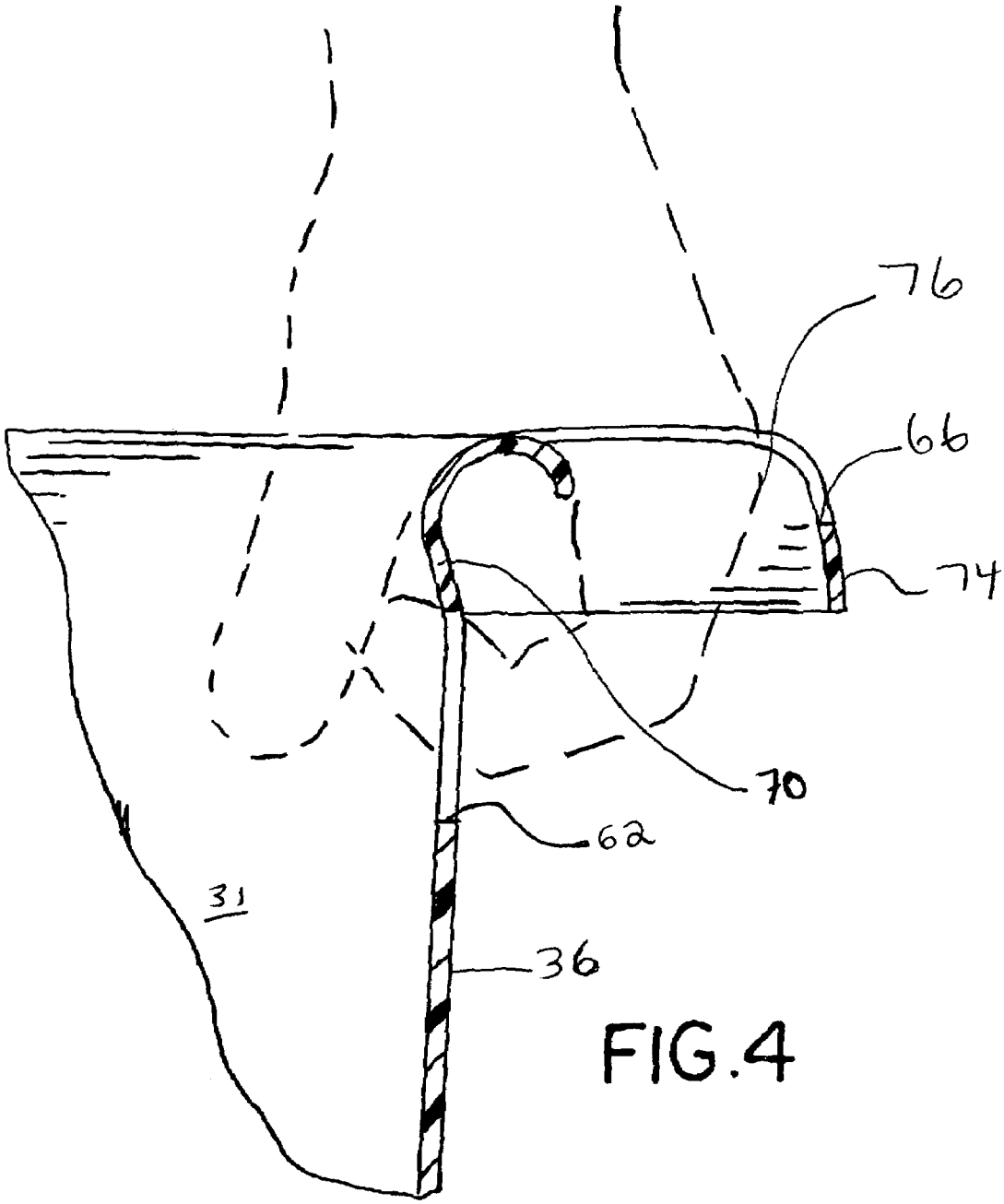
FIG. 4 is a fragmentary cross-sectional view of the handle of the laundry basket of FIG. 3, taken along line IV—IV in FIG. 3.

In use, as shown in FIG. 4, the user can insert his or her fingers through the first and second lip openings 64, 66 in the lip 44 and curl their fingers around the grips 68, 70 and through the first and second side openings 60, 62 in the first and second sidewalls 32, 34. Accordingly, the knuckle guards 72, 74 lie outward from the user's knuckles 76.

Figure 5:
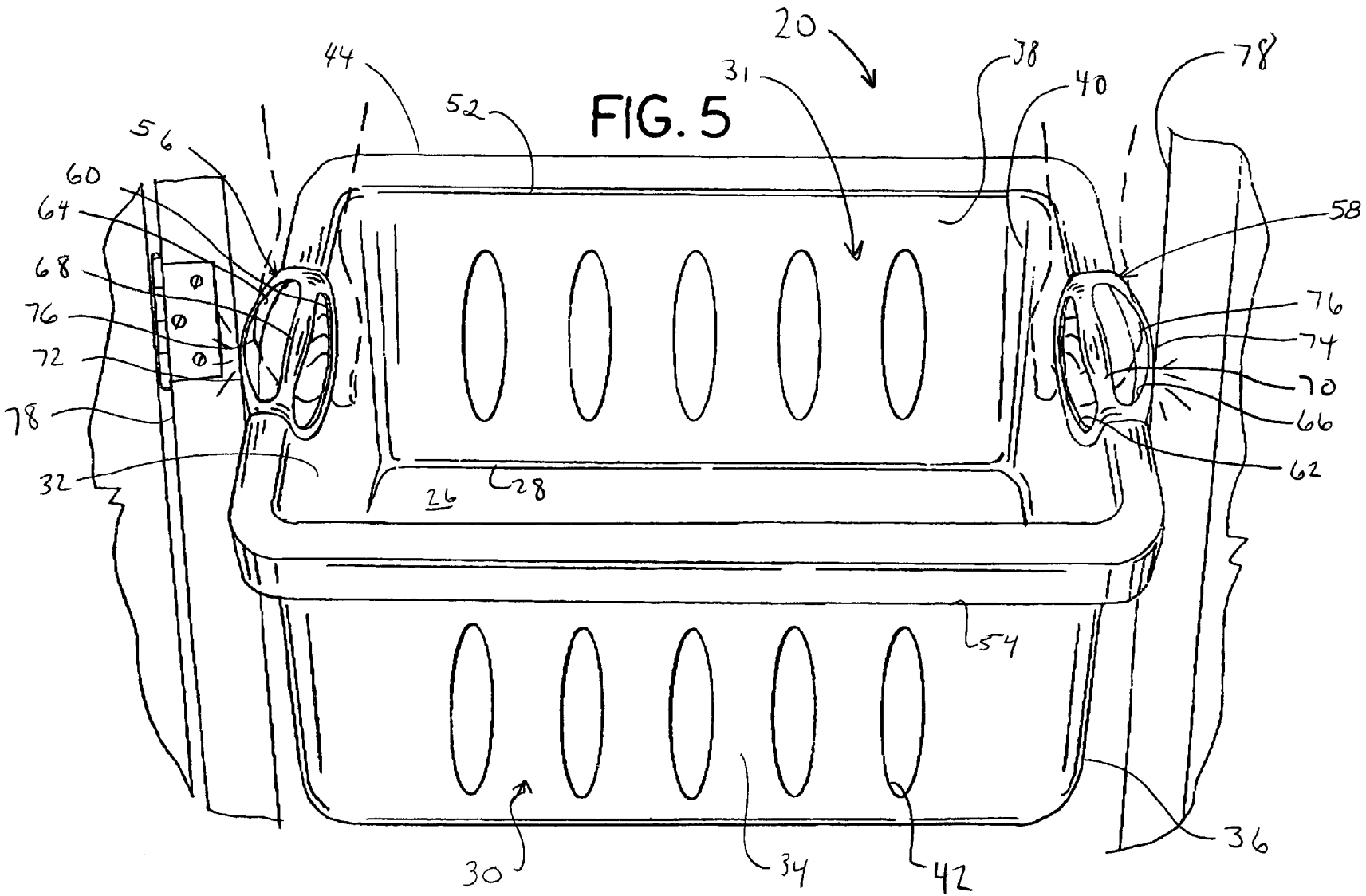
FIG. 5 is a perspective view of the laundry basket of FIG. 3 being carried through a doorway.

The user may then lift and carry the laundry basket 10, as shown in FIG. 5. The laundry basket 10 is shown empty in FIG. 5. However, the laundry basket 10 may be filled with clothing or other items. The user may carry the laundry basket 10 through a hallway or a doorframe 78. As the user carries the laundry basket 10 through the doorframe 78, the knuckle guards 72, 74 may impact the doorframe 78. This can occur if the doorframe 78 is narrow relative to the laundry basket 10, or if a heavy load is being carried, thereby making it difficult to maneuver the laundry basket 10. The guards 72, 74 can protect the user's knuckles 76 from the impact of the doorframe 78.

Figure 6:
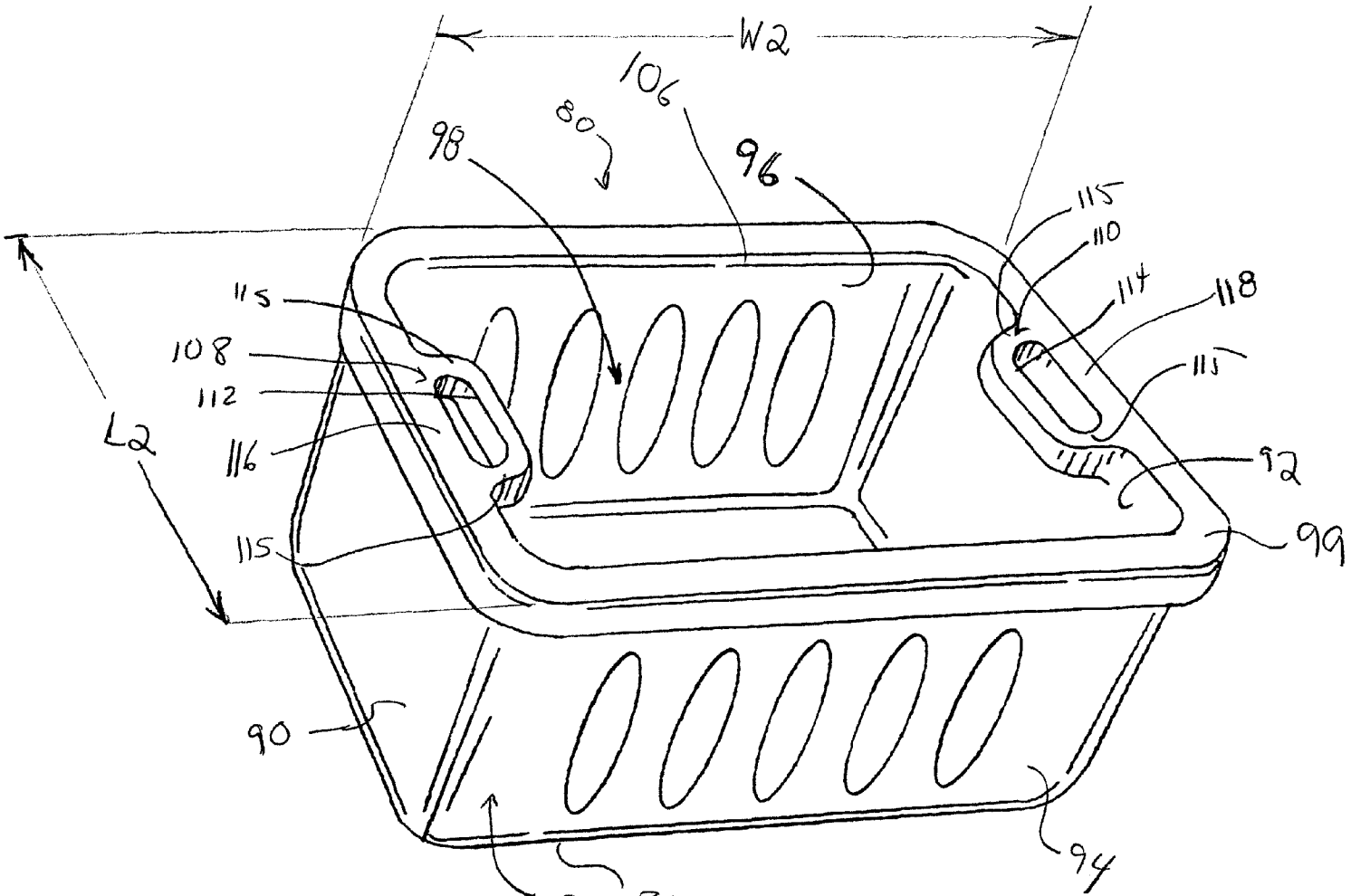
FIG. 6 is a perspective view of a second example of a laundry basket with knuckle protection.

In a second example, shown in FIG. 6, a laundry basket 80, includes a bottom wall 86 and a contiguous sidewall 88. In this example, the contiguous sidewall 88 includes a first sidewall 90, a second sidewall 92, a third sidewall 94, and a fourth sidewall 96. The contiguous sidewall 88 defines an interior 98 of the basket 80. In this example, the contiguous sidewall 88 is substantially rectangular, with the first sidewall 90 and the second sidewall 92 defining a width W2, and the third sidewall 94 and the fourth sidewall 96 defining a length L2 , shorter than the width W.

The contiguous sidewall 84 further includes a lip 99. In this example, the lip 99 is disposed on top of the sidewalls 90, 92, 94, and 96 and extends from the sidewalls 90, 92, 94, and 96 in an outward direction away from the interior 98 of the basket 20. The lip 99 can be joined to the sidewalls 90, 92, 94 and 96 at a radiused corner 106.

Adjoining the lip 99 and the first and second sidewalls 90 and 92 is a first handle 108 and a second handle 110, respectively. Each handle 108, 110 includes a grip 112, 114 that is adapted to be grasped by a user and extensions 115 that space the grips 112, 114 inwardly from the first and second sidewalls 90 and 92 into the basket interior. In this example, the handles 108, 110 are disposed inwards from the contiguous sidewall 88 into the interior 98 of the basket 80. Knuckle guards 116, 118 are disposed in the outward direction from the grips 112, 114 and in this example the knuckle guards 116, 118 are contiguous with the lip 99 and the first and third sidewalls 90 and 94. The grips 112, 114 can be ergonomically designed such that a user will have maximum control of the basket 80 while carrying it, as is known in the art.

Figure 7:
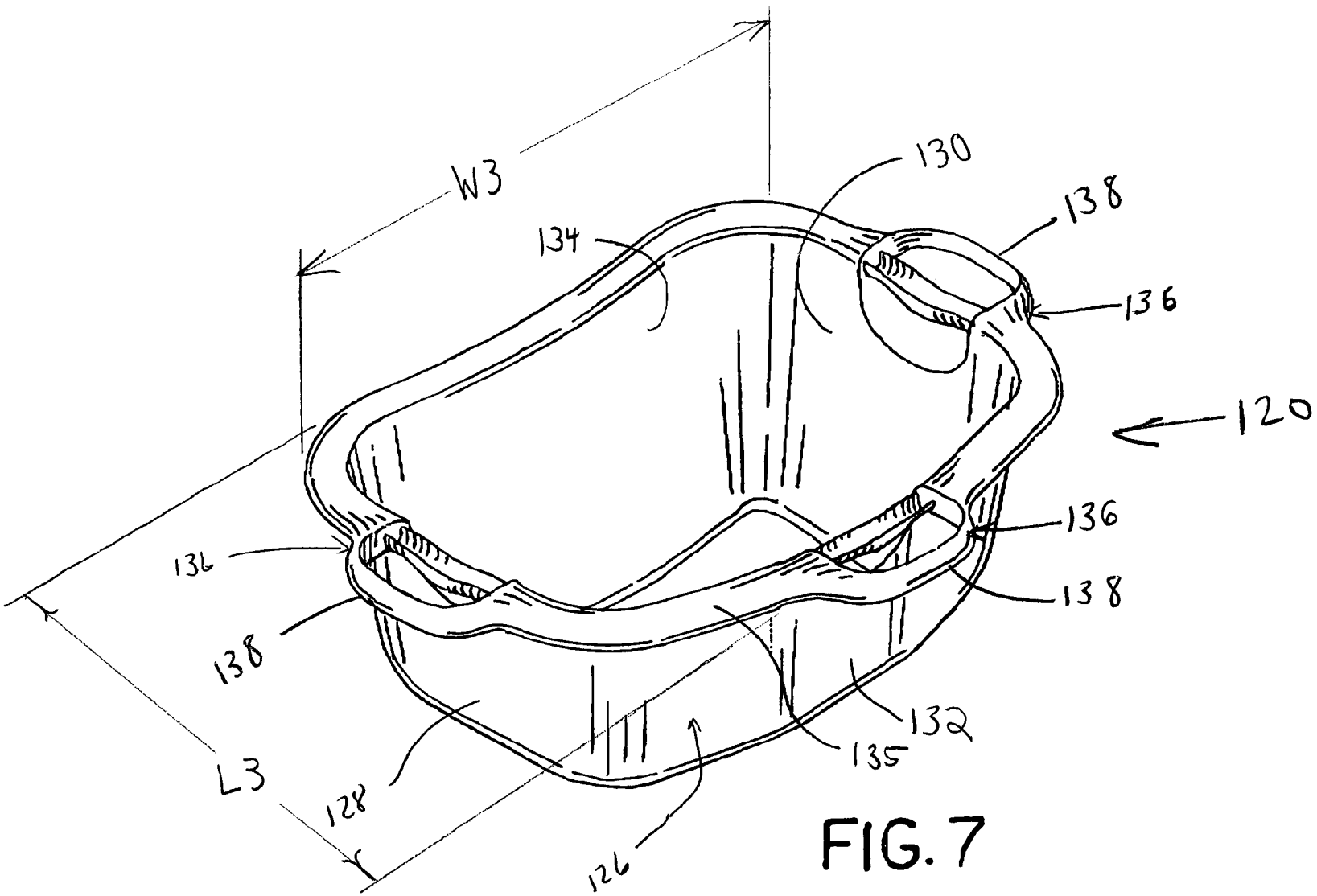
FIG. 7 is a perspective view of a third example of a laundry basket with knuckle protection.

In a third example, shown in FIG. 7, a laundry basket 120 includes a contiguous sidewall 126 that includes a first, second, third, and fourth sidewall 128, 130, 132, and 134, respectively. In this example, the contiguous sidewall 126 is substantially rectangular, with the first sidewall 128 and the second sidewall 130 defining a width W3, and the third sidewall 132 and the fourth sidewall 134 defining a length L3, shorter than the width W3.

The contiguous sidewall 126 further includes a lip 135 extending in an outward direction from the top of the sidewalls 128, 130, 132, and 134. Handles 136 with knuckle guards 138 are disposed in the lip 135 and first and second sidewall 128, 130 as in the previous examples. However, the third sidewall 132 is arched outward, and the fourth sidewall 134 is arched to curve around the user's body, as the fourth sidewall 134 is usually next to the user's body when the laundry basket 120 is being carried. This helps to increase the volume within the receptacle 122.

Further, a handle 136 with a knuckle guard 138 is disposed on the third sidewall 132. This can aid the user in carrying the laundry basket 120. The handle 136 and knuckle guard 138 can be constructed similar to either of the prior examples. This configuration of a handle 136 with a knuckle guard 138 in the third sidewall 132 can easily be implemented on the first two examples as well.

From the foregoing, one of ordinary skill in the art will appreciate that the present disclosure sets forth a basket with handles that incorporate protection for the hands. However, one of ordinary skill in the art could readily apply the novel teachings of this disclosure to any number of containers in which protection of the user's hands is desirable. This includes, but is not limited to, moving boxes, totes, coolers, etc. As such, the teachings of this disclosure shall not be considered to be limited to the specific examples disclosed herein, but to include all applications within the spirit and scope of the invention.

We claim:

1. A laundry basket, comprising:

a bottom wall with an outer periphery;

a contiguous sidewall extending up from the outer periphery of the bottom wall and defining an interior of the laundry basket;

a top portion of the sidewall forming a substantially peripheral lip; and a portion of the peripheral lip transitioning into a handle having grip and a knuckle guard spaced outward from the grip in a direction away from the interior of the basket, the grip and knuckle guard disposed substantially level with the lip;

the first handle including a first side opening in the contiguous sidewall, the first grip being formed as a portion of the contiguous sidewall above the first side opening.

2. The laundry basket of claim 1, wherein the contiguous sidewall includes a first, second, third and fourth sidewall extending up from the bottom wall, the first and second sidewalls being opposite from each other, the third and fourth sidewalls being opposite from each other.

3. The laundry basket of claim 2, wherein the contiguous sidewall is substantially rectangular, and wherein the first and second sidewalls are relatively longer than the third and fourth sidewalls.

4. The laundry basket of claim 2, wherein the first grip is disposed on the first sidewall, and further comprising:

a second grip operatively connected to the second sidewall, and a second knuckle guard disposed outward from the second grip in a direction away from the interior of the basket.

5. The laundry basket of claim 4, further comprising:

a third grip operatively connected to the third sidewall and a third knuckle guard disposed outward from the third grip in a direction away from the interior of the basket.

6. The laundry basket of claim 1, wherein the contiguous sidewall includes a concavely arched sidewall adapted to bear against the user.

7. The laundry basket of claim 6, wherein the contiguous sidewall further includes a first, second, and third sidewall.

8. The laundry basket of claim 1, wherein the first knuckle guard is disposed on the side of the contiguous sidewall opposite the interior of the basket.

9. The laundry basket of claim 1, wherein the first knuckle guard is a bar.

* * * * *